US010566731B1

(12) United States Patent
Sun et al.

(10) Patent No.: US 10,566,731 B1
(45) Date of Patent: Feb. 18, 2020

(54) OUTDOOR WATERPROOF CONNECTOR BOX

(71) Applicant: ROSENBERGER (SHANGHAI) TECHNOLOGY CO., LTD, Shanghai (CN)

(72) Inventors: Jiwei Sun, Jiangsu (CN); Liqi Zhao, Jiangsu (CN)

(73) Assignee: ROSENBERGER (SHANGHAI) TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/559,787

(22) Filed: Sep. 4, 2019

Related U.S. Application Data

(63) Continuation of application No. PCT/CN2019/094385, filed on Jul. 2, 2019.

(51) Int. Cl.
*H01R 13/58* (2006.01)
*H01R 13/52* (2006.01)

(52) U.S. Cl.
CPC ..... *H01R 13/5208* (2013.01); *H01R 13/5213* (2013.01)

(58) Field of Classification Search
CPC .. H01R 13/58; H01R 13/595; H01R 13/5812; H01R 103/00; H01R 35/02
USPC ..... 439/460, 469, 470, 472, 165
See application file for complete search history.

(56) References Cited

U.S. PATENT DOCUMENTS 4,508,410 A * 4/1985 Canham ..... H01R 4/2429 439/395
4,529,258 A * 7/1985 Anthony ..... H01R 33/22 439/142
4,749,369 A * 6/1988 Wang ..... H01R 13/516 439/459
4,822,286 A * 4/1989 Bianca ..... H01R 13/582 439/460
4,934,953 A * 6/1990 Tenham ..... H01R 12/79 439/417
6,093,050 A * 7/2000 Baum ..... H01C 7/12 439/412
6,196,865 B1 * 3/2001 Ruffel ..... H01R 13/56 439/470
6,953,362 B2 * 10/2005 Mossner ..... H01R 4/2433 439/395

* cited by examiner

*Primary Examiner* — Phuong Chi Thi Nguyen
(74) *Attorney, Agent, or Firm* — Locke Lord LLP; Tim Tinkang Xia, Esq.

(57) ABSTRACT

The invention discloses an outdoor waterproof connector box, which comprises a cable waterproof assembly, a fixing member, a wire inlet pedestal, a wiring base and a shell, wherein the wire inlet pedestal is provided with at least one waterproof hole for being inserted by the cable waterproof assembly, the wiring base is connected with the wire inlet pedestal, and the shell is sleeved outside the wire inlet pedestal and the wiring base, and the shell is hermetically connected with the wire inlet pedestal; and the fixing member is inserted from a side surface of the wire inlet pedestal to fix the cable waterproof assembly in the corresponding waterproof hole. The cable inlet and outlet of the invention are fast to seal, and the connector box has an excellent overall waterproof performance.

15 Claims, 3 Drawing Sheets

OUTDOOR WATERPROOF CONNECTOR BOX

CROSS REFERENCE TO RELATED APPLICATIONS

This application is a continuation of international application No. PCT/CN2019/094385, filed on Jul. 2, 2019, the disclosures of which are hereby incorporated by reference.

FIELD OF THE INVENTION

The present invention relates to a cable waterproof connection structure, and more particularly, to an outdoor waterproof connector box.

BACKGROUND

Optical fiber connector box is one of the most important devices in an optical fiber network, and is an apparatus that provides conditions for optical fiber splicing and branching, and protects an optical fiber connector, which is mainly used for straight-through and branch connection of laying modes such as overhead arrangement, pipeline and direct burial of the optical fiber cables of various structures.

Factors such as water tightness and volume of the optical fiber connector box have a direct impact on an optical fiber performance, a wiring protection capability, etc. A form of cable gland sealing of wire inlet and outlet holes is generally used in the traditional outdoor waterproof connector box, or a form of a box (generally square) of a larger size with a flip/open cover is used. The connector boxes of these two sealing structures have a larger installation interface size, and the waterproof performance of the traditional outdoor waterproof connector box is also poor. In addition, the installation of a square connector box is time-consuming and high in costs, and requires a larger installation space.

SUMMARY OF THE INVENTION

The present invention is intended to overcome the defects of the prior art, and provides an outdoor waterproof connector box with a good waterproof performance, a small volume and convenience in installation.

In order to achieve the object above, the present invention provides the following technical solutions: an outdoor waterproof connector box, comprises a cable waterproof assembly, a fixing member, a wire inlet pedestal, a wiring base and a shell, wherein the wire inlet pedestal comprises a first end surface and a second end surface opposite to each other, the first end surface is provided with at least one waterproof hole for being inserted by the cable waterproof assembly, the wiring base is connected with the second end surface;

the shell is sleeved outside the wire inlet pedestal and the wiring base, and is hermetically connected with the wire inlet pedestal;

one end of the cable waterproof assembly is provided with a first waterproof surface, and a second waterproof surface matched with the first waterproof surface is arranged in the waterproof hole;

the fixing member is inserted from a side surface of the wire inlet pedestal to fix the cable waterproof assembly in the corresponding waterproof hole, and by an acting force applied to the fixing member, the cable waterproof assembly is pushed along a direction close to the second waterproof surface of the waterproof hole until the first waterproof surface of the cable waterproof assembly is attached to the second waterproof surface of the waterproof hole.

Preferably, the cable waterproof assembly comprises two waterproof clamping assemblies buckled with each other, each waterproof clamping assembly comprises a cable waterproof clamping piece and an elastic sealing member, the elastic sealing member covers an inner wall of the cable waterproof clamping piece, one end of the elastic sealing member extends out of the cable waterproof clamping piece, and the first waterproof surface is formed by an outer surface of a part of the elastic sealing member extending out of the cable waterproof clamping piece Preferably, the cable waterproof assembly is internally provided with at least one cable hole for a cable to pass through, and an aperture of the cable hole is gradually decreased along a direction close to the first waterproof surface.

Preferably, a surface of the cable waterproof assembly is also provided with a fixing clamping surface, and the fixing member inserted into the wire inlet pedestal is limited onto the fixing clamping surface.

Preferably, the second waterproof surface of the waterproof hole is a tapered waterproof surface which gradually shrinks along a direction from the first end surface to the second end surface.

Preferably, a cable routing area is formed in the wiring base, the cable entering the wiring base is wound in the cable routing area according to an excess length, and a wire inlet end and a wire outlet end of the cable are butted in the cable routing area.

Preferably, the wire inlet end and the wire outlet end of the cable are welded, or connected through an adapter.

Preferably, both the wire inlet end and the wire outlet end of the cable are inputted and outputted from the wire inlet pedestal.

Preferably, two ends of the wiring base are respectively provided with a wire inlet pedestal, the wire inlet end of the cable is inputted from the wire inlet pedestal at one end, and the output end of the cable is outputted from the wire inlet pedestal at the other end.

Preferably, a fixing hook for fixing the adapter is arranged in the wiring base.

Preferably, a clamping groove matched with a bulge on a side edge of the adapter is formed on the fixing hook, and the bulge of the adapter is clamped in the clamping groove.

Preferably, a top end of the wiring base is in an opening shape.

Preferably, a sealing ring is arranged at an attached portion of the wire inlet pedestal and the shell, and the shell is hermetically connected with the wire inlet pedestal through the sealing ring.

Preferably, the shell and the wire inlet pedestal are also closed or opened through an unlockable clamping structure.

Preferably, the outdoor waterproof connector box is wholly or nearly cylindrical.

The present invention has the beneficial effects as follow.

1. The sealing structure of the present invention formed by the waterproof assembly of a cable inlet and outlet, the wire inlet pedestal and the fixing member realize fast sealing of wire inlet and outlet of the cable, is reliably waterproof, is applicable to outdoor environments, and has a waterproof and dustproof level as high as IP67.

2. Different from the existing square connector box design, the product of the present invention is entirely cylindrical, has a small volume, a light weight and a good site adaptability, and can be easily installed at a high place, hung on a rod, buried in ground, hidden in a rod or lapped on other devices, thus avoiding the high installation cost of the square box product and realizing large-capacity cable connection under the condition of small volume.

3. The wiring method for the connecting cable inside the product of the invention realizes that more excess length of the cable can be accommodated in a small space, and flexible maintenance operation can be performed, thus providing a low-cost and high-efficiency waterproof wiring scheme for the wiring of a micro base station of a 5G network.

REFERENCE NUMERALS

100 refers to wire inlet pedestal, 101 refers to first end surface, 102 refers to second end surface, 103 refers to waterproof hole, 104 refers to second waterproof surface, 105 refers to inserting hole, 106 refers to fixing piece positioning groove, 107 refers to sealing ring, 108 refers to shell fixing hook, 200 refers to cable waterproof assembly, 201 refers to cable waterproof clamping piece, 202 refers to elastic sealing member, 203 refers to sealing portion, 204 refers to compression portion, 205 refers to first waterproof surface, 206 refers to cable hole, 207 refers to half cable hole, 208 refers to fixing clamping surface, 300 refers to fixing member, 301 refers to fixing arm, 400 refers to wiring base, 401 refers to cable routing area, 402 refers to fixing hook, 403 refers to clamping groove, 500 refers to shell, 501 refers to clamping opening, 600 refers to cable, 601 refers to wire inlet end, 602 refers to wire outlet end, 700 refers to adapter, and 701 refers to bulge.

DETAILED DESCRIPTION OF THE PREFERRED EMBODIMENTS

The technical solutions of the embodiments of the present invention are clearly and completely described below with reference to the drawings of the present invention.

Figure 4:
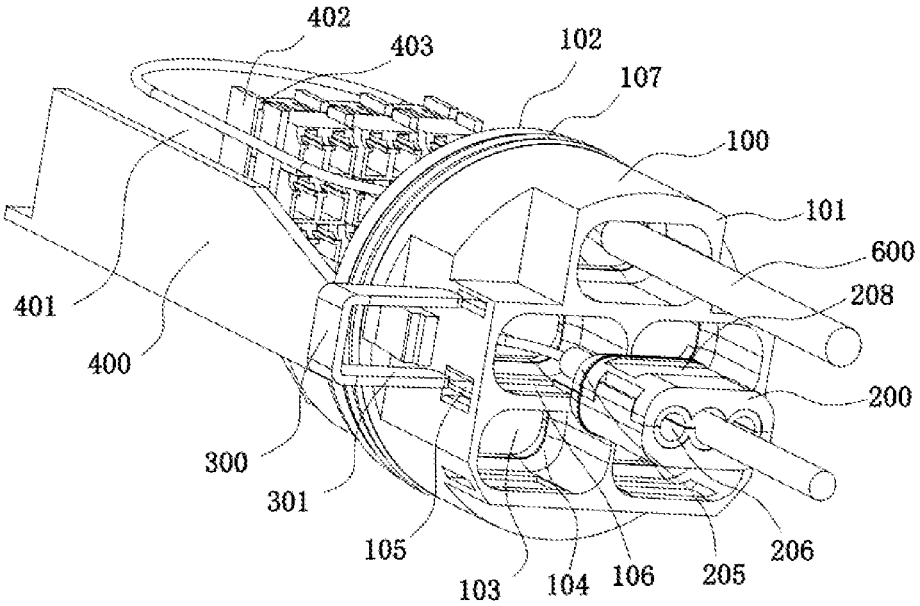
FIG. 4 is a structure diagram illustrating the installation of the cable waterproof assembly of the present invention.
Figure 5:
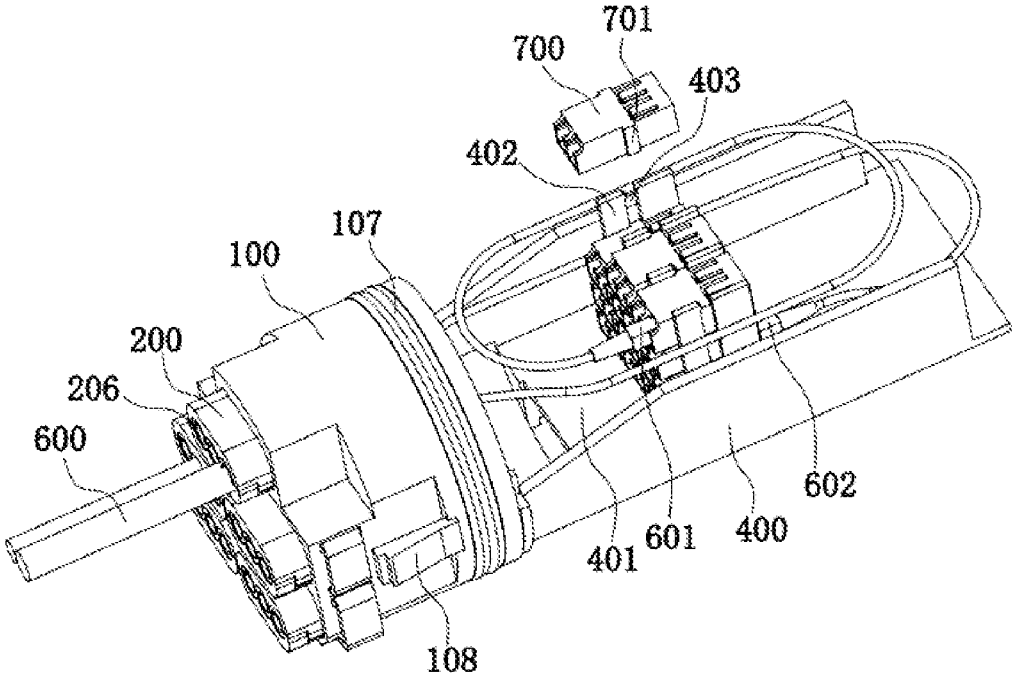
FIG. 5 is a stereoscopic structure diagram of a shell of the present invention.

With reference to FIG. 1, FIG. 2, FIG. 4 and FIG. 5, an outdoor waterproof connector box disclosed by the present invention comprises a wire inlet pedestal 100, a cable waterproof assembly 200, a fixing member 300, a wiring base 400 and a shell 500, wherein the wire inlet pedestal 100 is used for input and/or output of a cable 600, and comprises a first end surface 101 and a second end surface 102 opposite to each other, the first end surface 101 is provided with at least one waterproof hole 103 for being inserted by the cable waterproof assembly 200 and penetrating the second end surface 102, and when a plurality of waterproof holes 103 are arranged, a cable waterproof assembly 200 is correspondingly inserted into each waterproof hole 103. As shown in FIG. 4, in the embodiment, the first end surface 101 is provided with five waterproof holes 103, and a longitudinal section of each waterproof hole 103 is a rounded rectangle.

In addition, as shown in FIG. 4, a second waterproof surface 104 matches with the cable waterproof assembly 200 for sealing and waterproofing is formed in each waterproof hole 103, and preferably, the second waterproof surface 104 is a tapered waterproof surface which gradually shrinks along a direction from the first end surface 101 to the second end surface 102.

Figure 3:
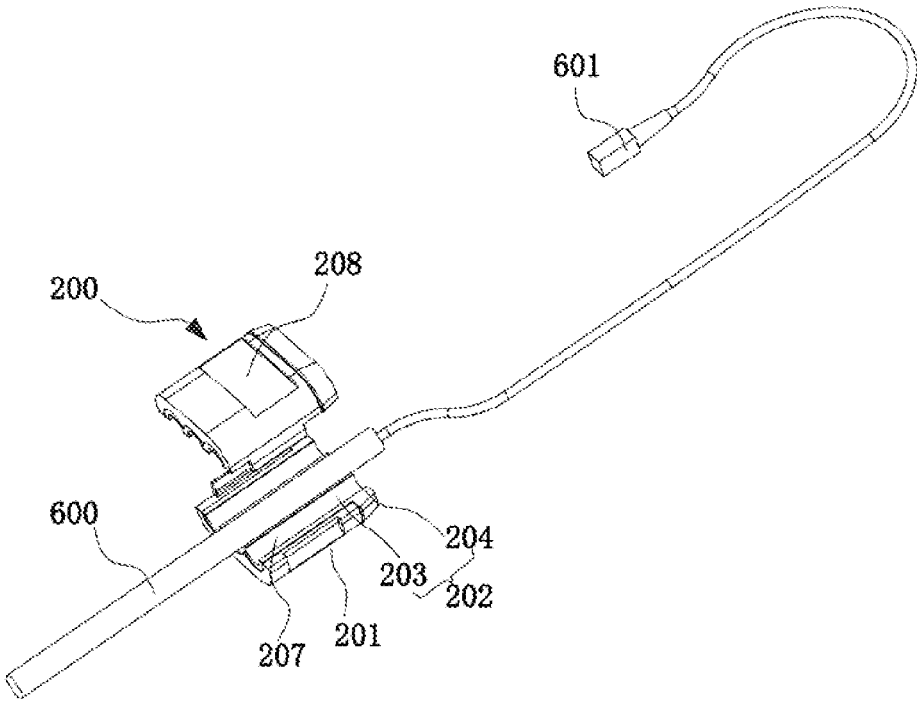
FIG. 3 is a stereoscopic structure diagram of a cable waterproof assembly of the present invention.

The cable waterproof assembly 200 is used for the cable 600 to pass through, and is matched with the wire inlet pedestal 100 to perform waterproofing and sealing on the inlet wire and/or the outlet wire of the cable 600. In the embodiment, as shown in FIG. 3, the cable waterproof assembly 200 comprises two waterproof clamping assemblies buckled with each other, and the cable 600 is clamped by the two waterproof clamping assemblies. Each waterproof clamping assembly comprises a cable waterproof clamping piece 201 and an elastic sealing member 202, the cable waterproof clamping piece 201 is used as an outer shell of the cable waterproof assembly 200, and the elastic sealing member 202 specifically comprises an sealing portion 203 and a compression portion 204 integrated, wherein the sealing portion 203 covers an inner wall of the cable waterproof clamping piece 201, the compression portion 204 extends outwardly from one end of the sealing portion 203 (along a direction close to the second end surface 102 in the embodiment), and an outer surface of the compression portion 204 forms a first waterproof surface 205. In the embodiment, the elastic sealing member 202 is a waterproof rubber member.

At least one cable hole 206 for the cable 600 to pass through is axially arranged in the cable waterproof assembly 200, and in the embodiment, three cable holes 206 are arranged in each cable waterproof assembly 200, i.e., fifteen cables 600 can be inputted and/or outputted according to the outdoor waterproof connector box in this embodiment. Two waterproof clamping assemblies are buckled together to form a cable hole, and an aperture of each cable hole 206 is gradually decreased along a direction close to the first waterproof surface 205, so that the cable hole 206 is a tapered hole, and the tapered hole design enables a sealing and attaching effect between the cable 600 and the cable hole 206 to be better, so as to have a better waterproof performance. Specifically, at least one half cable hole 207 is axially arranged in each cable waterproof clamping piece 201, and each cable hole 206 is formed by two half cable holes 207, and in the embodiment, a longitudinal section of the cable hole 206 is a circle, a longitudinal section of each half cable hole 207 is a semicircle, and the half cable hole 207 is also an angled tapered hole.

In addition, an outer surface of the cable waterproof assembly 200 is also provided with a fixing clamping surface 208 for fixing a limiting fixing member 300. In the embodiment, the fixing clamping surface 208 is arranged on the outer surface of the cable waterproof clamping piece 201 and is formed by inwardly recessing from the outer surface of the cable waterproof clamping piece 201.

As shown in FIG. 4, the fixing member 300 is used for fixing the cable waterproof assembly 200 in the waterproof hole 103 of the wire inlet pedestal 100, this can realize the compression and waterproofing of the cable waterproof assembly 200. In the embodiment, each waterproof hole 103 of the wire inlet pedestal 100 is corresponding to a fixing member 300, the fixing member 300 is a U-shaped fixing piece, which comprises two opposite fixing arms 301, a side surface of the wire inlet pedestal 100 is provided with an inserting hole 105 for the fixing arm 301 of the fixing member 300 to be inserted, the two fixing arms 301 of the fixing member 300 are inserted into the waterproof hole 103 through the corresponding inserting hole 105, and after insertion, each fixing arm 301 is limited to the fixing clamping surface 208 on the corresponding cable waterproof clamping piece 201, so that the fixing member 300 clamps the cable waterproof assembly 200 between the two fixing arms 301, and limits and fixes the cable waterproof assembly 200 in the waterproof hole 103. In addition, an inner wall of each waterproof hole 103 corresponding to the fixing arm 301 of the fixing member 300 is also provided with a fixing piece positioning groove 106.

In addition, after the fixing member 300 is inserted into the waterproof hole 103 and is limited to the fixing clamping surface 208 of the cable waterproof clamping piece 201, an acting force is applied to the fixing member 300, so that the fixing member 300 moves along the inserting hole 105 and axially pushes the cable waterproof assembly 200 to move in a direction (i.e., forward) close to the second waterproof surface 104 of the waterproof hole 103. Thus, the fixing member 300 pushes the elastic sealing member 202 to move and makes the first waterproof surface 205 of the elastic sealing member 202 to be hermetically attached to the second waterproof surface 104 of the waterproof hole 103, i.e., the fixing member 300 compresses the elastic sealing member 202 to form a waterproof function. The fixing piece positioning groove 106 provides a reverse supporting force for compressing the elastic sealing member 202 during a compression process of the elastic sealing member 202.

Figure 2:
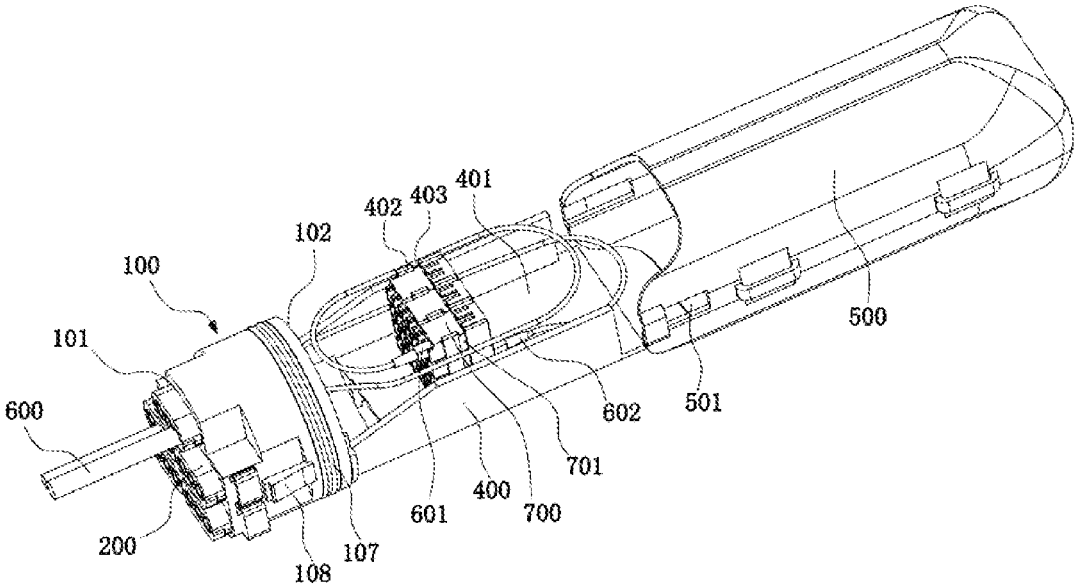
FIG. 2 is an explosive structure diagram of the present invention.

The wiring base 400 is connected with the second end surface 102 of the wire inlet pedestal 100, the wiring base 400 is used for the wiring of the cable 600. Specifically, as shown in FIG. 2, in the embodiment, a cable routing area 401 is formed in the wiring base 400, and the cable 600 comprises a wire inlet end 601 and a wire outlet end 602, wherein the cable 600 enters the cable routing area 401 of the wiring base 400 through the waterproof hole 103 of the wire inlet pedestal 100 after being clamped by the cable waterproof assembly 200, and in the cable routing area 401, the wire inlet end 601 and the wire outlet end 602 of the cable 600 are both wound in the cable routing area 401 according to an excess length, and are butted in the cable routing area 401. In implementation, the wire inlet end 601 and the wire outlet end 602 of the cable 600 can be welded, and can also be butted through an adapter 700. In the embodiment, the wire inlet end 601 and the wire outlet end 602 of the cable 600 are butted through the adapter 700. Specifically, the wire inlet end 601 of the cable 600 is wound in the cable routing area 401 according to the excess length and is connected with one end of the adapter 700, and the wire outlet end 602 of the cable 600 is connected with the other end of the adapter 700 and is wound in the cable routing area 401 according to the excess length. This routing mode for connecting the cable 600 in the cable routing area 401 can realize accommodation of more excess length of a cable in a small space.

In the embodiment, the wiring base 400 is internally provided with a plurality of fixing hooks 402 for fixing the adapter 700, at least one adapter 700 is fixed between every two fixing hooks 401, and each fixing hook 401 is provided with a clamping groove 403 matched with a bulge 701 on a side edge of the adapter 700, so that the bulges 701 on two sides of the adapter 700 are respectively clamped in the clamping grooves 403 of two fixing hooks 402, and in implementation, a plurality of adapters 700 can be stacked and fixed between every two fixing hooks 402. In the embodiment, four fixing hooks 402 are arranged side by side in the wiring base 400, the plurality of adapters 700 are stacked and fixed between every two fixing hooks 402, during disassembly, the adapters 700 stacked in each column are disassembled from top to bottom in sequence, while each adapter 700 is separated from the clamping grooves 403 of the two fixing hooks 402 from bottom to top to realize disassembly, so as to be convenient in disassembly.

In addition, the inlet wire and the outlet wire of the cable 600 can be respectively inputted and outputted from the same wire inlet pedestal 100, and in the embodiment, the inlet wire and the outlet wire of the cable 600 are inputted and outputted from the same wire inlet pedestal 100, i.e., outputed from the same end of the wiring base 400. Alternatively, the inlet wire and the outlet wire of the cable 600 can also be inputted and outputted from two opposite ends of the wiring base 400, for example, two ends of the wiring base 400 are respectively provided with a wire inlet pedestal 100, and after being inputted from the wire inlet pedestal 100 at one end, the cable 600 is outputted from the wire inlet pedestal 100 at the other end.

In addition, preferably, an upper end of the wiring base 400 is in an opening shape, and the opening shape design can facilitate the adapter to be taken out from the wiring base 400, so as to facilitate the insert and extract of the wire inlet end 601 and the wire outlet end 602 of the cable 600. Moreover, in the embodiment, an end of the wiring base 400 far away from the second end surface 102 of the wire inlet pedestal 100 (i.e., a tail portion) is also in an opening shape, which is more convenient for the insert and extract of the cable 600, the disassembly and maintenance of the adapter 700, and the like.

Figure 1:
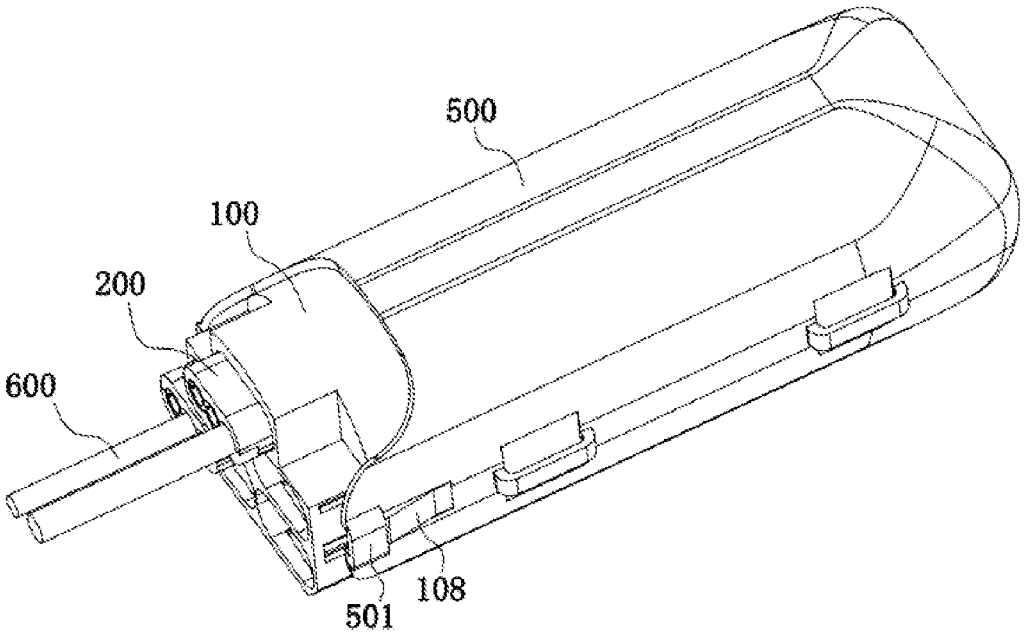
FIG. 1 is a stereoscopic structure diagram of the present invention after assembly.

With reference to FIG. 1 and FIG. 2, the shell 500 is sleeved outside the wire inlet pedestal 100 and the wiring base 400, specifically sleeved from a tail portion of the wiring base 400 along a direction close to the first end surface 101 of the wire inlet pedestal 100, and the shell 500 is hermetically connected with the wire inlet pedestal 100. Specifically, in the embodiment, a sealing ring 107 is circumferentially arranged on the outer surface of the wire inlet pedestal 100, and the sealing ring 107 is located between the shell 500 and the wire inlet pedestal 100, so that a closed waterproof space is formed in the shell 500, and the wiring base 400, the adapter 700 and the butted cable 600 in the wiring base 400 and the like are accommodated in the waterproof space to realize sealing and waterproofing.

In addition, as shown in FIG. 1 and FIG. 2, the shell 500 and the wire inlet pedestal 100 are also connected through an unlockable clamping structure, which facilitates the closing or opening of the shell 500. Specifically, in the embodiment, the clamping structure comprises a shell fixing clamping hook 108 arranged on the wire inlet pedestal 100 and a clamping opening 501 arranged on the shell 500, when being closed, the shell fixing clamping hook 108 on the wire inlet pedestal 100 is embedded into the clamping opening 501 of the shell 500 and limited by the clamping opening 501, and when being opened, the shell fixing clamping hook 108 on the wire inlet pedestal 100 is detached from the clamping opening 501 of the shell 500.

In addition, in the embodiment, the entire wire inlet pedestal 100 is approximately in a cylindrical shape, so that the entire connector box is approximately in a cylindrical shape. Different from the existing square wiring box structure, the present invention is overall an cylindrical structure, has a small volume, a light weight and a good site adaptability, and can be easily installed at a high place, hung on a rod, buried in ground, hidden in a rod or lapped on other devices, thus avoiding the high installation cost of the square box product and realizing large-capacity cable connection under the condition of small volume.

In addition, in specific implementation, the type of the adapter 700 can be replaced to adapt to various optical fiber connectors, and the adapter 700 can also be replaced with a power connection terminal to adapt to the connection requirements of the power cable; some cables can be used as optical/copper signal connections, and some cables can be used as power cables, which can all realize the waterproof connection function; and an access form of a photoelectric hybrid cable can also be used to realize signal connection and power connection.

In addition, the product of the present invention can be applied to 5G wiring and can also be widely applied to other outdoor connection and wiring node schemes; and moreover, except for being used for waterproof connection of the cable, the product can also be internally provided with other devices to adapt to various applications.

The technical contents and technical features of the present invention have been disclosed above, but those skilled in the art can still make various replacements and modifications not deviating from the spirit of the present invention based on the instruction and disclosure of the present invention. Therefore, the protection scope of the present invention shall not be limited to the contents disclosed by the embodiments, but shall include the various replacements and modifications not deviating from the invention, and shall be covered by the claims of the patent application.

The invention claimed is:

1. An outdoor waterproof connector box, comprising a cable waterproof assembly, a fixing member, a wire inlet pedestal, a wiring base and a shell, wherein the wire inlet pedestal comprises a first end surface and a second end surface opposite to each other, the first end surface is provided with at least one waterproof hole for being inserted by the cable waterproof assembly, the wiring base is connected with the second end surface;

the shell is sleeved outside the wire inlet pedestal and the wiring base, and is hermetically connected with the wire inlet pedestal;

one end of the cable waterproof assembly is provided with a first waterproof surface, and a second waterproof surface matched with the first waterproof surface is arranged in the waterproof hole;

the fixing member is inserted from a side surface of the wire inlet pedestal to fix the cable waterproof assembly in the corresponding waterproof hole; and by an acting force applied to the fixing member, the cable waterproof assembly is pushed along a direction close to the second waterproof surface of the waterproof hole until the first waterproof surface of the cable waterproof assembly is attached to the second waterproof surface of the waterproof hole.

2. The outdoor waterproof connector box according to claim 1, wherein the cable waterproof assembly comprises two waterproof clamping assemblies buckled with each other, each waterproof clamping assembly comprises a cable waterproof clamping piece and an elastic sealing member, the elastic sealing member covers an inner wall of the cable waterproof clamping piece, one end of the elastic sealing member extends out of the cable waterproof clamping piece, and the first waterproof surface is formed by an outer surface of a part of the elastic sealing member extending out of the cable waterproof clamping piece.

3. The outdoor waterproof connector box according to claim 1, wherein the cable waterproof assembly is internally provided with at least one cable hole for a cable to pass through, and an aperture of the cable hole is gradually decreased along a direction close to the first waterproof surface.

4. The outdoor waterproof connector box according to claim 1, wherein a surface of the cable waterproof assembly is also provided with a fixing clamping surface, and the fixing member inserted into the wire inlet pedestal is limited onto the fixing clamping surface.

5. The outdoor waterproof connector box according to claim 1, wherein the second waterproof surface of the waterproof hole is a tapered waterproof surface which gradually shrinks along a direction from the first end surface to the second end surface.

6. The outdoor waterproof connector box according to claim 1, wherein a top end of the wiring base is in an opening shape.

7. The outdoor waterproof connector box according to claim 1, wherein a sealing ring is arranged at an attached portion of the wire inlet pedestal and the shell, and the shell is hermetically connected with the wire inlet pedestal through the sealing ring.

8. The outdoor waterproof connector box according to claim 1, wherein the shell and the wire inlet pedestal are also closed or opened through an unlockable clamping structure.

9. The outdoor waterproof connector box according to claim 1, wherein the outdoor waterproof connector box is wholly or nearly cylindrical.

10. The outdoor waterproof connector box according to claim 1, wherein a cable routing area is formed in the wiring base, the cable entering the wiring base is wound in the cable routing area according to an excess length, and a wire inlet end and a wire outlet end of the cable are butted in the cable routing area.

11. The outdoor waterproof connector box according to claim 10, wherein both the wire inlet end and the wire outlet end of the cable are inputted and outputted from the wire inlet pedestal.

12. The outdoor waterproof connector box according to claim 10, wherein two ends of the wiring base are respectively provided with a wire inlet pedestal, the wire inlet end of the cable is inputted from the wire inlet pedestal at one end, and the output end of the cable is outputted from the wire inlet pedestal at the other end.

13. The outdoor waterproof connector box according to claim 10, wherein the wire inlet end and the wire outlet end of the cable are welded, or connected through an adapter.

14. The outdoor waterproof connector box according to claim 13, wherein a fixing hook for fixing the adapter is arranged in the wiring base.

15. The outdoor waterproof connector box according to claim 14, wherein a clamping groove matched with a bulge on a side edge of the adapter is formed on the fixing hook, and the bulge of the adapter is clamped in the clamping groove.

* * * * *